US006185913B1

(12) United States Patent
Cappi et al.

(10) Patent No.: US 6,185,913 B1
(45) Date of Patent: Feb. 13, 2001

(54) EQUIPMENT FOR THE PACKAGING OF PRODUCTS IN A MODIFIED AND CONTROLLED ATMOSPHERE, WITH A STRETCHABLE AND GAS-TIGHT FILM

(75) Inventors: Angelo Cappi, Vignola; Renato Rimondi, Bazzano, both of (IT)

(73) Assignee: A.W.A.X. Progettazione e Ricerca S.r.l., Vignola (IT)

( * ) Notice: Under 35 U.S.C. 154(b), the term of this patent shall be extended for 0 days.

(21) Appl. No.: 09/180,525

(22) PCT Filed: Sep. 5, 1997

(86) PCT No.: PCT/EP97/04815

§ 371 Date: Nov. 9, 1998

§ 102(e) Date: Nov. 9, 1998

(87) PCT Pub. No.: WO98/12111

PCT Pub. Date: Mar. 26, 1998

(30) Foreign Application Priority Data

Sep. 18, 1996 (IT) ..... BO96A0465

(51) Int. Cl.[7] ..... B65B 31/00
(52) U.S. Cl. ..... 53/511; 53/510; 53/556
(58) Field of Search ..... 53/89, 90, 91, 53/94, 110, 167, 510, 511, 228, 556

(56) References Cited

U.S. PATENT DOCUMENTS 1,770,379 * 7/1930 Young ..... 53/110
2,763,107 * 9/1956 Day et al. ..... 53/110
3,996,725 * 12/1976 Walles ..... 53/510 X
4,707,334 * 11/1987 Gerhard ..... 53/510 X
4,944,132 * 7/1990 Carlsson et al. ..... 53/167
5,001,886 * 3/1991 Turtschan ..... 53/167
5,371,998 * 12/1994 Johnson et al. ..... 53/510 X

FOREIGN PATENT DOCUMENTS

206096 * 12/1986 (EP) .
1343586 9/1962 (FR) .
WO 94/10041 5/1994 (WO) .

* cited by examiner

*Primary Examiner*—Linda Johnson
(74) *Attorney, Agent, or Firm*—Larson & Taylor plc

(57) ABSTRACT

A packaging machine which carries out the conventional packaging of products with a stretchable and gas-tight film is housed in a main chamber (1) which is seable and contains a modified and controlled atmosphere suitable for the conservation of the product to be packaged. The product enters and leaves the main chamber by passing through corresponding sealable airlock chambers (7, 8) provided with corresponding automatic doors (107, 207, 108, 208) and in any case designed to provide a seal with respect to the external environment and to the main chamber to which these chambers are attached. When the outer sides of the airlock chambers are opened, their inner sides are closed, so that the modified and controlled atmosphere cannot issue from the main chamber. Before the airlock chambers are connected to the main chamber, these chambers have their outer sides closed and a mechanism may be provided to evacuate the ambient atmosphere from them and, if necessary, fill them with the modified and controlled atmosphere.

2 Claims, 5 Drawing Sheets

EQUIPMENT FOR THE PACKAGING OF PRODUCTS IN A MODIFIED AND CONTROLLED ATMOSPHERE, WITH A STRETCHABLE AND GAS-TIGHT FILM

The invention relates to machines for the packaging with stretchable film of products normally previously disposed in trays, and concerns improvements to enable these machines to form packages containing a modified and controlled atmosphere, with the aim of better conservation of the packaged product. The term "modified and controlled atmosphere", or more simply "modified atmosphere", denotes at least any one of the following conditions:

a) an atmosphere different from the external ambient atmosphere, consisting of one or more gases suitable for the conservation of the packaged product and having the same pressure as the external atmosphere;

b) an atmosphere different from the external ambient atmosphere, consisting of one or more gases suitable for the conservation of the packaged product and having a pressure greater than the external atmospheric pressure;

c) an atmosphere identical to the external ambient atmosphere but at a markedly lower pressure, typical of the packaging called "vacuum packaging";

d) an atmosphere different from the external atmosphere, formed by one or more gases suitable for the conservation of the packaged product and having a pressure markedly lower than the external pressure, typical of the packaging called "vacuum packaging".

The packaging of the products with stretchable film is at present generally carried out with a gas-permeable film. However, stretchable gas-tight films are available at present on the market.

This patent application tackles the technical problem of how to be able to provide any machine for packaging products with stretchable film, for example the machine described in U.S. Pat. No. 3,967,433 (Bonfiglioli), capable of producing packages containing a modified atmosphere, suitable for the purposes of conserving the product.

To resolve this problem, according to the known art of the packaging of products with gas-tight, heat-sealable, but not stretchable film, it is necessary, at the moment of formation of the packaging around the product, before its closure, to evacuate with suitable means the air inside the package, and, if necessary, to introduce the modified atmosphere into the package which at the correct time is heat-sealed and closed so that it is gas-tight. The machines using these known solutions are slow and of complex construction and doubtful reliability, since it is extremely difficult to control precisely the phases of evacuation of the ambient air from the package and of any refilling of the said package with the modified atmosphere.

In the known art, the modified atmosphere, when it consists of gases other than those of the ambient atmosphere, is generally prepared in advance from time to time according to the type of product to be packaged and is stored in a container from which it is taken gradually in the necessary quantity. When the machine has to package a type of product different from that of the preceding cycle, it is necessary to replace the storage container which supplies the modified atmosphere. It is evident that this condition impedes the rapid adaptation of the machine to the packaging of different products.

Packaging machines using stretchable film have a high output per hour, and would therefore be adversely affected by the aforesaid known solutions. In order to be able to produce packages with stretchable gas-tight film, under a vacuum and/or containing a modified and controlled atmosphere for the conservation of the product, it has been necessary to devise a new solution which would be easily applied, would have high technological reliability, and, above all, would allow the packaging machine to operate at a high speed. According to the invention, the formation and closure of the package with stretchable film are carried out in a main chamber with means which maintain in it a modified atmosphere according to at least one of the aforesaid four conditions a), b), c), d). It is evident that the packaging cycle is simplified, since it is not necessary to use the present means which operate selectively on individual packages and it is possible to use an ordinary packaging machine with stretchable film. Each package is provided internally with the atmosphere modified for the purposes of the conservation of the product, since the same package is formed and closed in an environment which is completely filled with the modified atmosphere. The product enters and leaves the said main chamber by passing through corresponding entry and exit airlock chambers which are provided with corresponding doors for sealing with respect to the external environment and which are connected to the said main chamber. When the outer sides of the entry and exit chambers are opened, their inner sides are closed, in such a way that modified atmosphere does not issue from the main chamber. Before the inner doors which connect the entry and exit chambers to the main chamber are opened, the outer sides of these chambers are closed, and means may be provided to "evacuate" the ambient atmosphere from them and if necessary to introduce the modified atmosphere into them.

In the equipment according to the invention, when the packaging of the product has to be carried out in a modified atmosphere, the main chamber is also made to be connected to a plurality of storage containers, each containing the primary gases which participate in the formation of the modified atmosphere for the conservation of the product, and mixing means are provided to control the supply of the gas from the said containers and may be programmed so that the atmosphere required from time to time for the conservation of the products to be packaged is formed and maintained in the packaging chamber and if necessary also in the airlock chamber. This solution permits a simple and rapid adaptation of the machine to the packaging of different products which require controlled atmospheres having different characteristics.

The closest prior art know to applicant is repersented by document FR-A-1 343 586. According to this document, there is disclosed a method and apparatus for filling and closure of metallic drums with liquid substances in a sterilized environment. Apart from the different scope, clearly the apparatus according to the said prior art document differs in a substantial manner from the equipment in accordance with the present invention, as it will appear evident from the following description.

Further characteristics of the invention and the advantages derived therefrom will be more clearly evident from the following description of a preferred embodiment of the invention, illustrated purely by way of example and without restriction in the figures on the attached sheets of drawings, in which.

Figure 1:
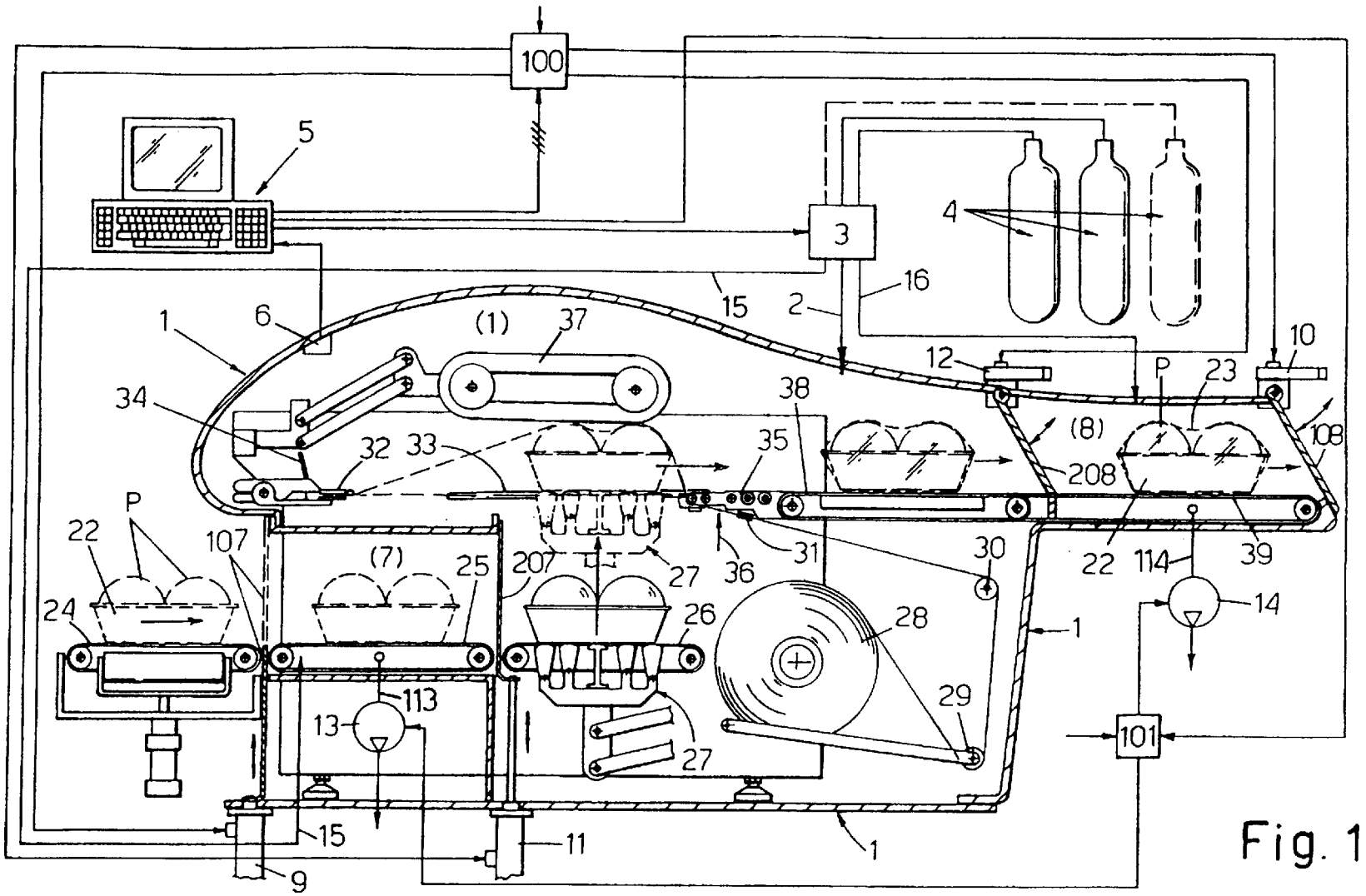
FIGS. 1 and 2 show equipment for packaging with stretchable film, improved according to the invention and capable of producing packages containing modified atmosphere or "vacuum" packages of the usual type or those with a residue of modified atmosphere.

FIG. 1 shows how the products P, disposed for example in trays 22, are fed cyclically by a conveyor 24 into an entry airlock chamber 7, which is sealable and is for example of the tunnel type, having at its opposite ends sealing doors 107, 207, of the guillotine type for example, with corresponding operating means 9, 11. A conveyor 25 runs longitudinally in the chamber 7 and on the opening of the door 107 receives the product from the said conveyor 24 and on the opening of the other door 207 transfers the said product to a sealable main chamber 1, to which the said chamber 7 is attached and which contains the various and/or main components of an ordinary packaging machine using stretchable film, for example one of the type cited in the introduction to the present disclosure. In the chamber 1, the product to be packaged is, for example, picked up by a comb conveyor, with belts 26, between which is disposed an elevator 27 which when commanded raises the product to the packaging station, as indicated in broken lines. The packaging film, which is gas-tight and stretchable, is unwound from a reel 28 and run around means 29, 30, then passes through a dispenser 31 and is held at its end by a gripper 32 which on command can be driven with a horizontal movement of approach to and withdrawal from the said dispenser 31, to spread in the packaging station a portion of film 23 against which the product to be packaged is subsequently raised and pushed. With suitably combined movements of the gripper 32 with the pusher 34 and lateral grippers and folders 33, the product is moved to the static folder 35, while the four flaps of the portion of film 23 controlled by these means are folded under the product and are overlapped on each other. At the correct time, the elevator 27 returns to the low position and the portion of film 23 which wraps the product is cut by suitable means indicated schematically by the arrow 36. The number 37 indicates the presser which holds the product correctly during the packaging phase. While the gripper 32 is lowered under the folder 35 and grips the new leading edge of the film held by the dispenser 31, the packaged product moves on to the conveyor 38 which heat-seals the overlapping flaps of the packaging film 23.

The wall of the chamber 1 which is located after the heat-sealing conveyor 38 is attached to a sealable airlock chamber 8, designed for the discharge of the packaged product and having on its opposite sides sealing doors 108, 208, of the flap type for example, with corresponding actuators 10, 12. A conveyor 39 runs longitudinally in this chamber 8 and on the opening of the door 208 receives the product from the said conveyor 38 and on the opening of the door 108 discharges it from the airlock chamber in question.

According to the invention, the main chamber 1 is connected to at least one conduit 2 leading from a battery of containers 4 for the storage of the various gases necessary for the formation in the said chamber of the controlled atmosphere which is necessary from time to time for the packaging of the products, the exit of the gases from these containers being controlled by intercepting and mixing means 3 which in turn are controlled by a central processor 5 with a screen and programming keyboard. The processor 5, by means of a sensor 6, detects the composition and/or quantity of the atmosphere in the chamber 1 and is designed in such a way that, by the preceding means 2, 3, 4, it can maintain a modified atmosphere within predetermined and programmed parameters in the chamber 1.

The actuators 9, 10, 11 and 12 which control the opening and closing of the doors 107, 207 and 108, 208 of the airlock chambers 7, 8 are connected to a supply interface 100 which is also controlled by the aforesaid central processor 5.

According to a preferred embodiment of the invention, the chambers 7 and 8 are connected at 113 and 114 to corresponding suction means 13, 14, controlled through the appropriate interface 101 by the processor 5, and, in opposition to these means, conduits 15 and 16, connected for example to part of the group 3, are joined to the said chambers for the introduction of a controlled atmosphere on command.

The equipment designed in this way operates as follows. The processor 5 is used to determine the characteristics of the modified atmosphere which is to be created and maintained in the main chamber 1, and the said processor, by means of the monitoring provided by the sensor 6, automatically keeps these characteristics constant. At the start of each operation of the equipment, the outer doors 107 and 108 are closed, while at least one or both of the inner doors 207, 208 are opened so that the main chamber communicates with one or both of the airlock chambers and in these conditions the pumps 13 and 14 are operated to extract the ambient air from the chambers, after which the said pumps are stopped, the inner doors 207, 208 are closed and the processor 5 operates the means 3, 4 to introduce into the main chamber the conservation gas or gases in the necessary quantity and at the necessary pressure. The start of an operating cycle requires the opening of the outer door 107 and the operation of the conveyors 24 and 25 for the introduction of a product into the entry chamber 7, after which the said conveyors are stopped, the said door is closed and means 13 come into operation for the evacuation of the ambient atmosphere contained in the chamber 7 and the conduit 15 is then operated to introduce some of the controlled atmosphere into the said chamber 7. At this point, the door 207 is opened, and the conveyors 25 and 26 are operated to transfer the product from the entry chamber 7 to the main chamber 1, above the elevator 27, after which the said conveyors are stopped and the door 207 is re-closed to isolate the chamber 7 from the chamber 1. While the next product is fed into the chamber 7, the product which was previously introduced into the chamber 1, on to the elevator 27, is raised by the latter, forced against the portion of film 23 spread in the packaging station and is wrapped with this film by the combined action of the group of lateral grippers and folders 33, the frontal folders 32–35 and the pusher 34, while the cutting means 36 come into operation at the correct time to separate the packaging film from the dispenser 31. Part of the modified atmosphere which uniformly occupies the main chamber 1 remains trapped in the packaging 23 which wraps the product, and this condition is made stable and permanent when the packaged product passes on to the heat-sealing conveyor 38 which seals the overlapping flaps of the package.

While the aforesaid phase of packaging is being executed in the main chamber 1, in the exit chamber 8 the means 14 for evacuating the ambient atmosphere are operated, and the modified atmosphere is introduced into this chamber through the conduit 16. When the packaging of the product is completed in the chamber 1, the door 208 of the chamber 8 is opened and after the passage of the product this door is re-closed automatically. Subsequently the door 108 is opened and the conveyors 38 and 29 are operated to discharge the packaged product from the chamber 8, after which the whole cycle described above is repeated.

Suitable means may be provided by which the modified atmosphere which occupies the chambers 7 and 8 is alternatively recovered instead of being dispersed into the atmosphere. To simplify the machine, the conduits 15, 16 may also be eliminated, since the introduction of the controlled atmosphere into the airlock chambers 7 and 8 may be carried out alternatively by the main chamber 1 when, on completion of the evacuation of the ambient atmosphere from the said chambers 7 and 8, these are put into communication with the main chamber by the opening of the inner doors 207, 208.

Figure 3:
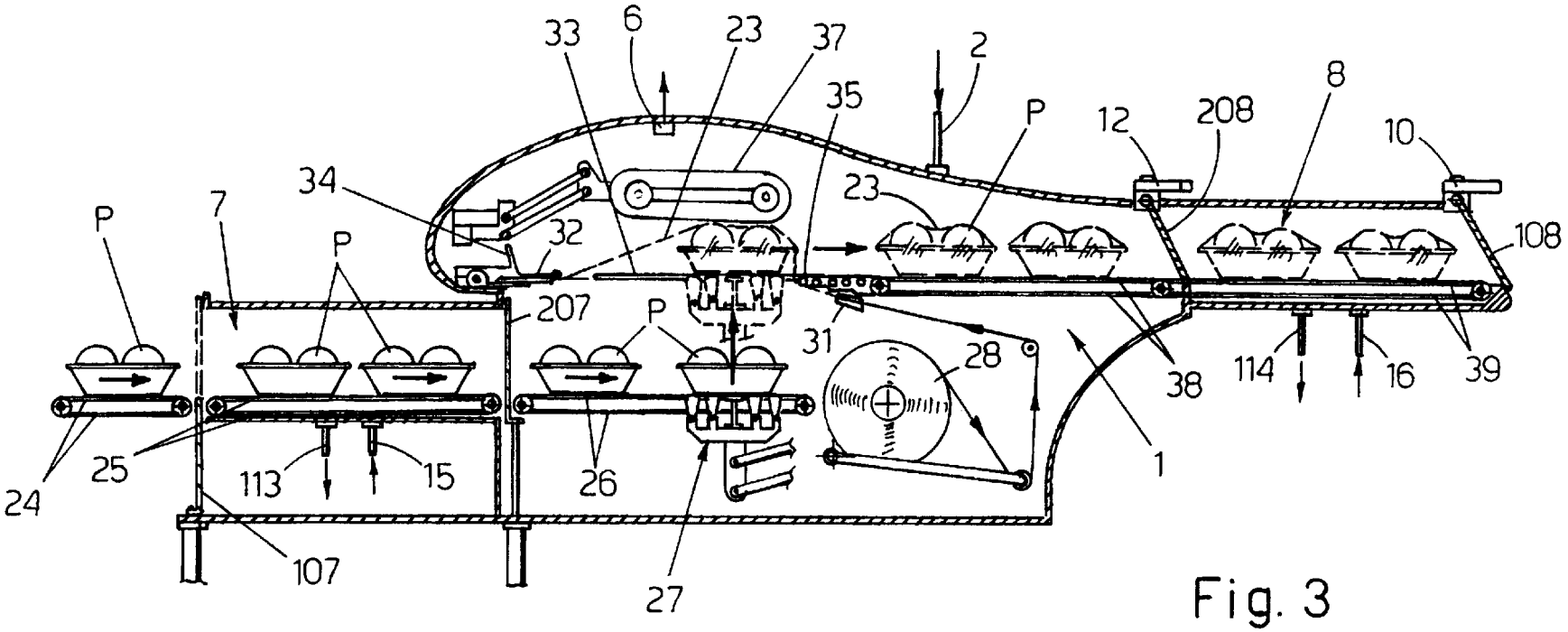
FIG. 3 shows schematically a variant embodiment of the equipment shown in the preceding figures, with means of collection in the phases of feeding and discharge of the products.

The airlock chambers 7, 8 preferably have the smallest possible volume, in order to simplify the operations of evacuation of the ambient atmosphere from them and subsequent saturation with the modified atmosphere. However, it is to be understood that the entry and exit chambers may alternatively have volumes such that a phase of accumulation or collection of the products is provided, in order to ensure a continuous and rapid operation of the packaging machine which operates in the same chamber 1 and to limit the packaging frequency of the airlock chambers 7–8. FIG. 3 shows such a variant, according to which the conveyors 25 and 39 of the airlock chambers 7, 8 and the conveyors 26 and 38, which respectively supply the elevator 27 and carry out the heat sealing of the package 23, have a length such that more than one product can be supported.

The simple way in which the problem of the packaging of the products in a modified atmosphere is resolved is evident, since it is thereby unnecessary to create and/or introduce the conservation atmosphere into the individual packages. It is also evident that, by the simple programming of the processor 5, it is possible to prepare the equipment rapidly for the packaging in a modified atmosphere of any type of product which requires any suitable mixture of the principal gases from the storage containers 4.

Figure 2:
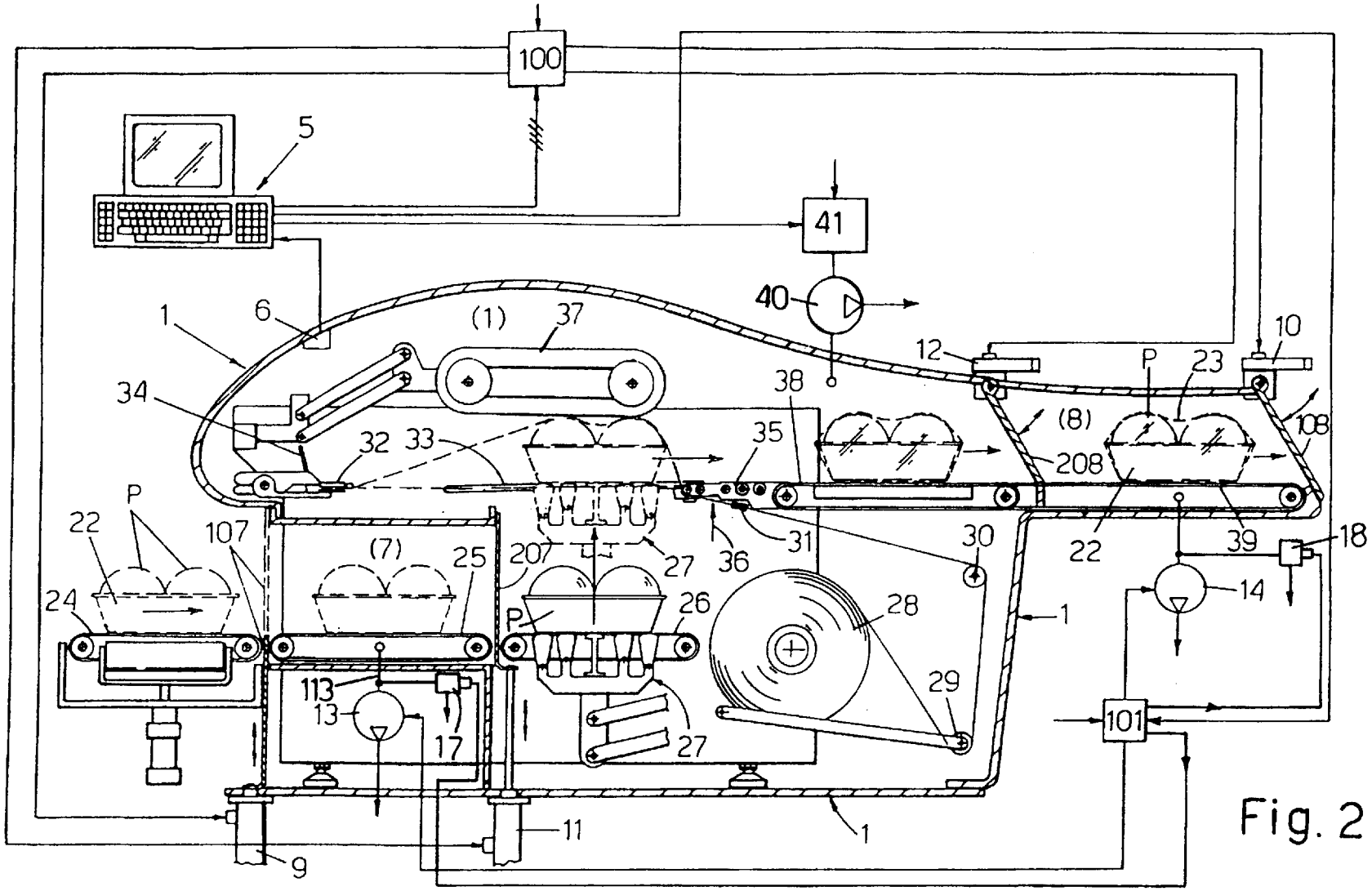

The equipment illustrated in the variant shown in FIG. 2 relates to what is called "vacuum" packaging of the products. This equipment differs from the equipment shown in FIG. 1 in the absence of the storage containers 4 of the gases to form the controlled conservation atmosphere and of the corresponding programmable mixer 3, as well as in the absence of the conduits 2, 15, 16 for introduction of the modified atmosphere into the main chamber 1 and into the airlock chambers 7, 8. In this case, the airlock chambers 7, 8 are acted on only by the suction means 13, 14 which can produce the vacuum in these chambers before they are connected to the main chamber 1 which is also connected to a suction pump 40 controlled by the processor 5 through the interface 41, to maintain a correct vacuum level in this chamber. The numbers 17 and 18 indicate solenoid valves which on command connect the chambers 7 and 8 to the ambient atmosphere before the opening of the outer doors 107, 108, in such a way that this opening is facilitated. According to a variant embodiment of the solution shown in FIG. 2, the pumps 13 and 14 may be eliminated when the volume of the airlock chambers 7, 8 is limited, since the small variations of pressure created in the connection of such chambers to the main chamber can easily be compensated by the main pump 40.

By combining the solutions described and illustrated in FIGS. 1 and 2, in a way which can be easily understood and applied by those skilled in the art, it is possible to produce equipment capable of producing packages in a vacuum which contain within them residues, not of the ambient atmosphere, but of a controlled atmosphere suitable for the better conservation of the packaged product. In this case, at least the main chamber 1 and if necessary also the airlock chambers 7, 8 will be connected to the corresponding conduits 2, 15, 16 for supplying the conservation gas or gases from the means 3 and 4 mentioned previously with reference to FIG. 1. The considerations mentioned with reference to FIG. 3 are also applicable to the variant shown in FIG. 2.

To provide faster operation of the machine, each of the airlock chambers 7, 8 may be formed from a plurality of chambers disposed in a closed ring, one after another, and arranged in such a way that while a first chamber is connected to the exterior to receive a product, at least one second and subsequent chamber containing the product is in the process of modification of the internal atmosphere, and a third chamber, with the internal atmosphere already modified, is in communication with the main chamber 1. At least one fourth airlock chamber is closed and disposed after the third of the said chambers, between this and the first chamber, so that, when the said airlock chambers are moved by one step and change their relative positions, a product is loaded into and discharged from the main chamber and this chamber is never connected to the exterior.

Figure 4:
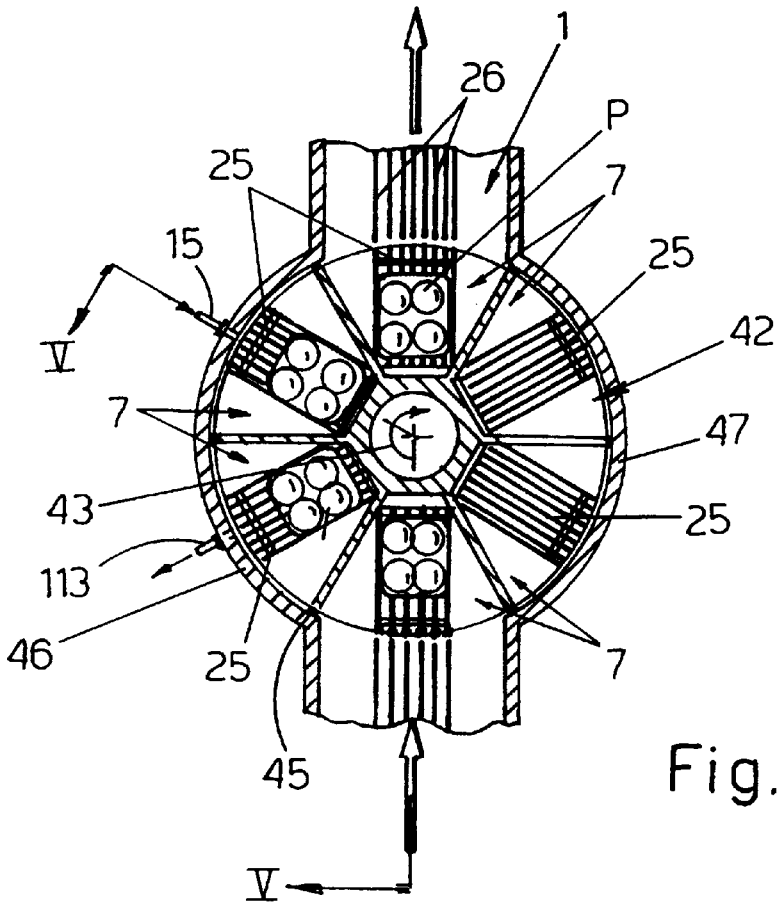
FIG. 4 is a schematic plan view from above and in partial section of an airlock chamber of the multiple-use type, with which it is possible to operate at a high speed and with almost continuous cycles.
Figure 5:
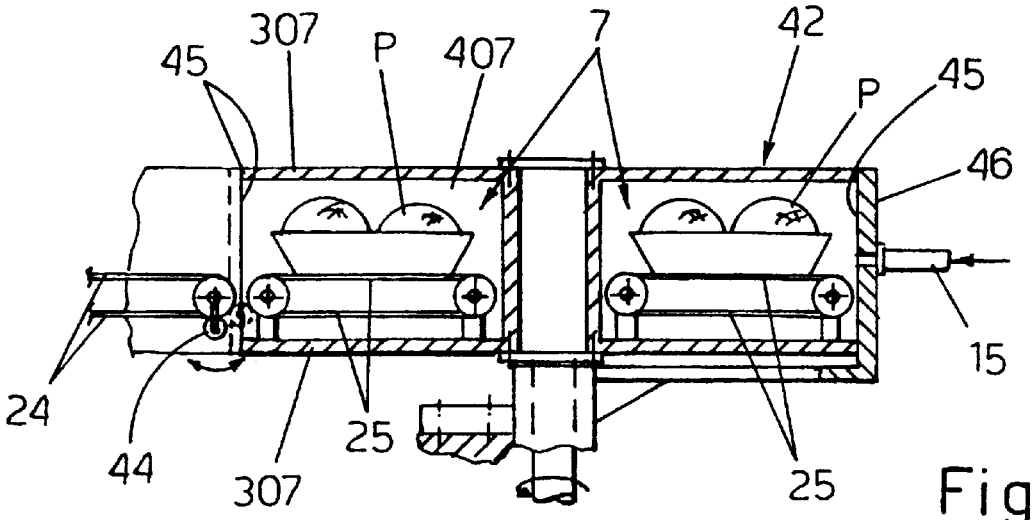
FIG. 5 shows details of the solution shown in FIG. 4, in section along the lines V—V.

A first embodiment of this concept of a solution is shown in FIGS. 4 and 5 and relates to the airlock chambers 7 which supply the product to the main chamber 1. The airlock chambers 7 are formed by the division into radial segments of a cylindrical hollow structure 42, in the form of a turret, which, at the command and by the action of suitable means which are not illustrated, rotates by steps about its vertical axis, for example in the clockwise direction indicated by the arrow 43. Each airlock chamber comprises its own bottom and top walls 307 and its own side walls 407, is open towards the outside and carries at a short distance from its base a small horizontal conveyor 25 which is aligned initially with the external conveyor 24 to receive a product to be packaged, and is then aligned with the conveyor 26 of the chamber 1, to transfer the product to the elevator of the packaging machine. The conveyors 25 may be free-running and may be made to rotate by the conveyor which they contact, for example by means of a coupling device of the oscillating type formed by friction or gear wheels 44 which are brought by an actuator (not illustrated) from the rest position indicated by the solid lines in FIG. 5 to that indicated by the broken lines, and vice versa. During the clockwise stepping rotation of the turret 42, the edges of the apertures of the airlock chambers 7, with the corresponding seals 45, interact with a fixed wall 46 which closes the said chambers and to which are attached the connections 113 and 15 which create the vacuum in the airlock chambers and introduce the modified atmosphere if necessary. In the subsequent movement away from the main chamber 1, the airlock chambers 7 are closed at least initially by a fixed wall 47, which prevents the connection of the chamber 1 to the exterior through the said chambers 7. It is evident that the modified atmosphere which remains in the airlock chambers which leave the chamber 1 can be usefully recovered by suitable means and introduced into the left-hand chambers which move towards the main chamber. The solution shown in FIGS. 4 and 5 can also be used for the construction of the airlock chambers 8 which discharge the packaged product from the main chamber 1.

Figure 6:
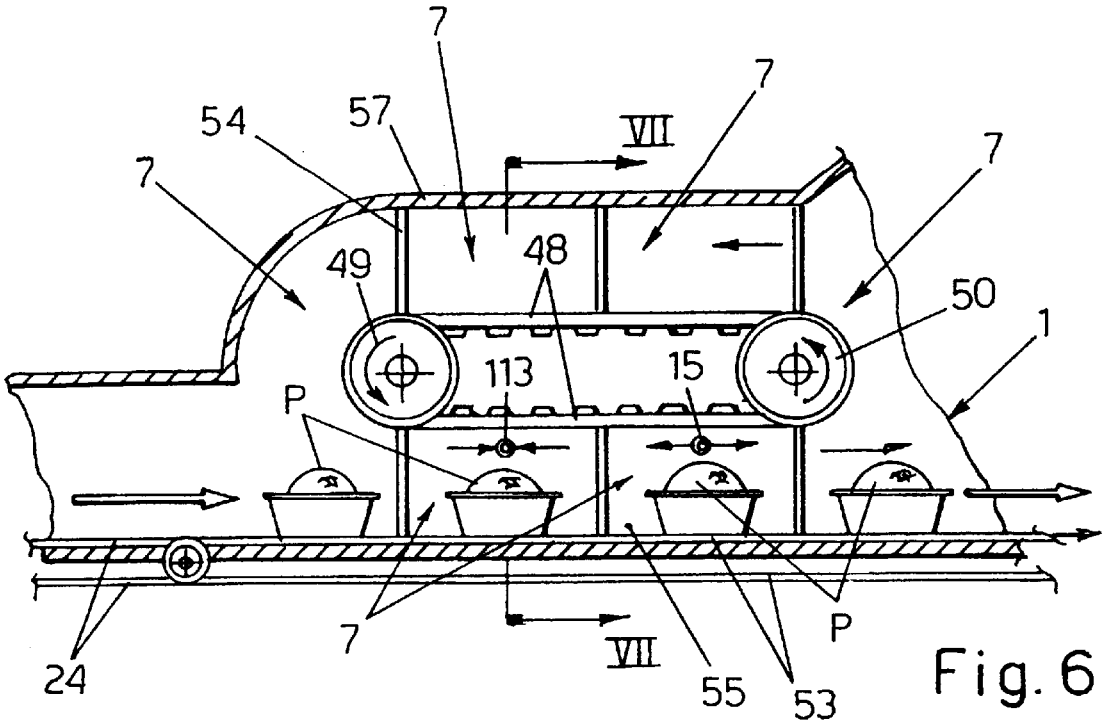
FIG. 6 is a side view in partial section of another airlock chamber of the multiple-use type.
Figure 7:
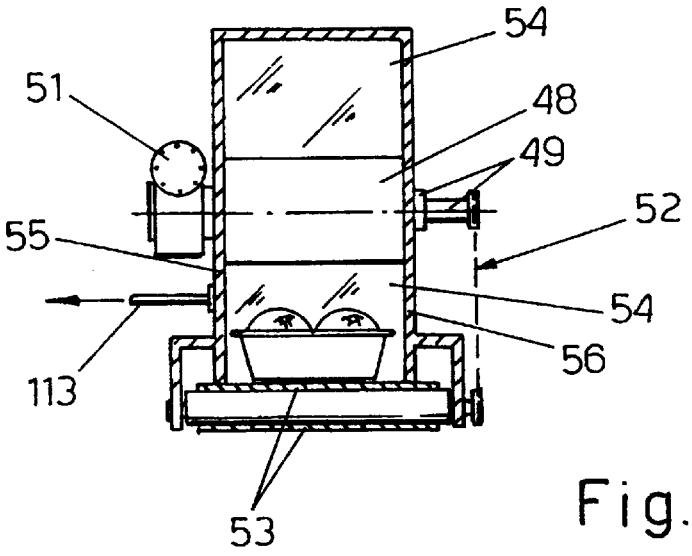
FIG. 7 shows details of the solution shown in FIG. 6, viewed through the section line VII—VII.

FIGS. 6 and 7 show another embodiment alternative to that shown in FIGS. 4 and 5, according to which the airlock chambers 7 are formed by an apron conveyor or toothed belt conveyor 48, running around a pair of toothed pulleys 49, 50 with horizontal and parallel axes, one of which is driven by a geared motor 51 which by means of the positive transmission 52 drives a further apron or belt conveyor 53 running parallel to and under the said conveyor 48. The conveyor 48 has a plurality of identical and equally spaced transverse plates 54 which in the lower path of this conveyor touch the conveyor 53 and thus form the airlock chambers 7 which are closed laterally by fixed walls 55, 56, to one of which are attached the conduits 113, 15 which create the vacuum and introduce the modified atmosphere if necessary. Opposite the conveyor 53 there is provided a fixed casing 57 with which the plates 54 interact to prevent the connection of the main chamber 1 to the exterior at least in the first section of the path of the airlock chambers away from the said main chamber. This solution may also be used for the construction of the airlock chambers 8.

The chambers 1, 7 and 8 of the equipment are made in such a way as to allow simple and rapid access to the parts disposed in them, for example for the replacement of the reel of film in the main chamber and/or for any maintenance requirement, and are preferably made wholly or partially from transparent material which reveals the operation of the internal components.

What is claimed is:

1. An apparatus for packaging products with a stretchable gas-tight film, comprising:

a wrapping machine which forms a package for the product which is sealed with respect to an ambient atmosphere, said wrapping machine including a) a reel of stretchable gas-tight film, b) an unwinding means for cyclically unwinding a portion of the film from the reel, c) a wrapping means for wrapping the product with the portion of film and for forming overlapping flaps of the film, and d) a sealing means for sealing the overlapping flaps of the film to form the sealed package;

a sealable main chamber in which said wrapping machine is completely contained;

an atmosphere means for creating and maintaining said chamber with a modified atmosphere having characteristics suitable for the conservation of the products packaged in said wrapping machine and modified with respect to the ambient atmosphere;

a sealable entry airlock chamber connecting said main chamber with the ambient atmosphere, said entry airlock chamber including a) an entry passage means for passing the products to be packaged into said entry airlock chamber from the ambient atmosphere, b) entry sealing doors by which an interior of said entry airlock chamber is connected to the ambient atmosphere and to the main chamber;

a sealable exit airlock chamber connecting said main chamber with the ambient atmosphere, said exit airlock chamber including a) an exit passage means for passing the packaged products into the ambient atmosphere from said exit airlock chamber, b) exit sealing doors by which an interior of said exit airlock chamber is connected to the ambient atmosphere and to the main chamber;

a control means for controlling said sealing doors such that a) in a first action of said control means, said entry airlock chamber is closed to the main chamber and opened to the ambient atmosphere, b) in a second action of said control means, said entry airlock chamber is closed to the ambient atmosphere and opened to the main chamber, c) in a third action of said control means, said exit airlock chamber is closed to the ambient atmosphere and opened to the main chamber, and d) in a fourth action of said control means, said exit airlock chamber is closed to the main chamber and opened to the ambient atmosphere;

an introducing means for introducing a product to be packaged into said entry airlock chamber after said first action of said control means;

an entry transferring means for transferring the product from the entry airlock chamber to the main chamber after said second action of said control means whereby said wrapping machine in said main chamber then forms the package with a portion of the modified atmosphere trapped in the wrapped product;

an exit transferring means for transferring the wrapped product into said exit airlock chamber from said main chamber after said third action of said control means; and a discharging means for discharging the wrapped product from said exit airlock chamber after said fourth action of said control means;

wherein said entry airlock chamber further comprises a) a transfer conveyor mounted on pulleys with horizontal axes such that said transfer conveyor is divided into a lower straight run and an upper straight run, b) a series of plates fixed to said transfer conveyor at equal intervals to divide the interior of said entry airlock chamber into respective chamber portions, c) respective side pieces provided on respective lateral sides of said transfer conveyor such that respective lateral edges of said plates interact respectively therewith to form a seal;

d) an underlying horizontal belt conveyor on which the products are supported and which is i) positioned underneath the lower straight run of said transfer conveyor, ii) connected mechanically to said transfer conveyor, and iii) spaced from the lower straight run of said transfer conveyor so that horizontal edges of said plates interact and form a seal therewith, e) a fixed casing integral with said side pieces which is located above said upper straight run of said transfer conveyor and which is spaced from the upper straight run of said transfer conveyor so that the horizontal edges of said plates interact and form a seal therewith, and f) a second atmosphere means for creating the modified atmosphere in each said chamber portion as each said chamber portion is located along said horizontal belt conveyor and is isolated from the ambient atmosphere; and such that in a cyclic manner the chamber portions change positions when advanced through an interval equal to the distance between said plates so as to constantly keep said main chamber isolated from the ambient atmosphere and so that, a) while a first chamber portion is connected to the ambient atmosphere to receive the product to be packaged, b) at least a second and subsequent chamber portion containing the product to be packaged is isolated from the ambient atmosphere and connected to said second atmosphere means, c) while a third and subsequent chamber portion containing the modified atmosphere and product is in communication with said main chamber for the introduction into said main chamber of the product to be packaged, and d) at least a fourth chamber portion is provided which is sealed from the ambient atmosphere and from said main chamber and which is located after the third chamber portion and between the third chamber portion and the first chamber portion.

2. An apparatus for packaging products with a stretchable gas-tight film, comprising:

a wrapping machine which forms a package for the product which is scaled with respect to an ambient atmosphere, said wrapping machine including a) a reel of stretchable gas-tight film, b) an unwinding means for cyclically unwinding a portion of the film from the reel and for feeding the portion of the film to a wrapping station, c) an elevator which lifts the product against the portion of the film at the wrapping station, d) a wrapping means at the wrapping station for folding the portion of the film about the product so that the flaps of the portion of the film are extended under tension onto a bottom of the product, and e) a sealing means for sealing the overlapping flaps of the film to form the sealed package;

a sealable main chamber in which said wrapping machine is completely contained;

an atmosphere means for creating and maintaining said chamber with a modified atmosphere having characteristics suitable for the conservation of the products packaged in said wrapping machine and modified with respect to the ambient atmosphere;

a sealable entry airlock chamber connecting said main chamber with the ambient atmosphere, said entry airlock chamber including a) an entry passage means for passing the products to be packaged into said entry airlock chamber from the ambient atmosphere, b) respective exterior and interior entry sealing doors by which an interior of said entry airlock chamber is alternatingly connected to and sealed from the ambient atmosphere and the main chamber respectively, said exterior and interior entry sealing doors i) being respectively fixed relative to an entrance and exit of said entry airlock chamber and ii) being formed as a respective entry guillotine member having a respective entry actuator providing a rectilinear reciprocating motion for moving each respective said entry guillotine member;

a sealable exit airlock chamber connecting said main chamber with the ambient atmosphere, said exit airlock chamber including a) an exit passage means for passing the packaged products into the ambient atmosphere from said exit airlock chamber, b) respective exterior and interior exit sealing doors by which an interior of said exit airlock chamber is alternatingly connected to and sealed from the ambient atmosphere and the main chamber respectively, said exterior and interior exit sealing doors i) being respectively fixed relative to an exit and entrance of said exit airlock chamber and ii) being formed as a respective exit guillotine member having a respective exit actuator providing a rectilinear reciprocating motion for moving each respective said exit guillotine member;

a control means for controlling said sealing doors such that a) in a first action of said control means, said entry airlock chamber is closed to the main chamber and opened to the ambient atmosphere, b) in a second action of said control means, said entry airlock chamber is closed to the ambient atmosphere and opened to the main chamber, c) in a third action of said control means, said exit airlock chamber is closed to the ambient atmosphere and opened to the main chamber, and d) in a fourth action of said control means, said exit airlock chamber is closed to the main chamber and opened to the ambient atmosphere;

an introducing means for introducing a product to be packaged into said entry airlock chamber after said first action of said control means;

an entry transferring means for transferring the product from the entry airlock chamber to the main chamber after said second action of said control means whereby said wrapping machine in said main chamber then forms the package with a portion of the modified atmosphere trapped in the wrapped product;

an exit transferring means for transferring the wrapped product into said exit airlock chamber from said main chamber after said third action of said control means; and a discharging means for discharging the wrapped product from said exit airlock chamber after said fourth action of said control means.

* * * * *